US008562109B2

(12) United States Patent
Miyazaki et al.

(10) Patent No.: US 8,562,109 B2
(45) Date of Patent: Oct. 22, 2013

(54) LIQUID EJECTION HEAD

(75) Inventors: Hirotaka Miyazaki, Yokohama (JP); Toshiaki Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/398,225

(22) Filed: Feb. 16, 2012

(65) Prior Publication Data

US 2012/0229572 A1 Sep. 13, 2012

(30) Foreign Application Priority Data

Mar. 10, 2011 (JP) ..... 2011-052980

(51) Int. Cl.
*B41J 2/21* (2006.01)

(52) U.S. Cl.
USPC ..... 347/44

(58) Field of Classification Search
USPC ..... 347/44
See application file for complete search history.

(56) References Cited

U.S. PATENT DOCUMENTS

| | | | | |
|---|---|---|---|---|
| 6,155,677 | A * | 12/2000 | Kitani et al. | 347/65 |
| 6,499,823 | B2 | 12/2002 | Okazaki et al. | |
| 2009/0303278 | A1 * | 12/2009 | Miyazaki | 347/20 |
| 2011/0279547 | A1 | 11/2011 | Hattori et al. | |

FOREIGN PATENT DOCUMENTS

JP 2006-239992 A 9/2006

* cited by examiner

*Primary Examiner* — Matthew Luu
*Assistant Examiner* — Michael Konczal
(74) *Attorney, Agent, or Firm* — Fitzpatrick, Cella, Harper & Scinto

(57) ABSTRACT

A liquid ejection head includes a recording element substrate having a member with a liquid ejection orifice, and a substrate having an energy-generating element for ejecting the liquid; a wiring substrate including wirings connected to terminals that are formed along an end portion side of a surface of the substrate where the element is formed and are electrically connected to the element; and a support member including a support supporting the recording element substrate through adhesive, a groove formed along the support and a wiring support supporting the wiring substrate. A sealing material is applied to a connection portion between the terminals and wirings and is applied to a bottom surface of the groove formed on an end portion side of the surface where no terminal is formed. A part of a side of the substrate corresponding to the end portion side is exposed without being covered with the sealing material.

4 Claims, 7 Drawing Sheets

LIQUID EJECTION HEAD

BACKGROUND OF THE INVENTION

1. Field of the Invention

The present invention relates to a liquid ejection head.

2. Description of the Related Art

An ink jet recording head used in an ink jet recording apparatus has heretofore been provided with a recording element substrate in which an ejection orifice group for ejecting an ink has been formed, a support member for holding and fixing the recording element substrate and an electrical wiring substrate having a lead terminal group connected to a connection terminal group of the recording element substrate. The connection terminal group provided in the recording element substrate and the lead terminal group provided protruding from the electrical wiring substrate make up an electrical connection portion.

The recording element substrate is held and fixed to the support member through an adhesive. A peripheral portion of the recording element substrate and the electrical connection portion are sealed with a sealing material for preventing connection failure such as corrosion caused by an ink and disconnection caused by external force. In the neighborhood of the electrical connection portion, for example, the peripheral portion of the recording element substrate is coated with a sealing material, a lower space of the lead terminal group is sealed with the sealing material, and the electrical connection portion including the lead terminal group is then coated with the sealing material. As the sealing material, is generally used a thermosetting resin that is relatively easy to be handled in a production process.

The ink jet recording head is subjected to a printing test before shipment, and ink droplets attached to the surface of the recording element substrate are then washed out. The surface of the recording element substrate is then dried, and a tape coated with a pressure-sensitive adhesive is lastly applied on the surface of the recording element substrate for preventing ink leakage from the ejection orifice upon physical distribution.

When a washing solution is left on the recording element substrate after the washing and drying steps, the remaining washing solution may fly off by vibration during transfer to the next step and re-applied to the surface of the recording element substrate in some cases. When the tape is applied on the surface of the recording element substrate in this state, ink bleeding or color mixing may be caused in some cases.

As a countermeasure against this, Japanese Patent Application Laid-Open No. 2006-239992 has proposed such a construction that ribs are respectively provided on three surfaces of a periphery of an electrical wiring substrate arranged in a support member except for a surface opposing a contact portion with an ink jet recording apparatus, and a groove is formed in a rib most distant from the contact portion among these ribs. The groove is a notch provided so as to open a part of the rib. The washing solution can be discharged to the outside through the groove provided in the rib opposing the contact portion in the drying step after the washing step to prevent the washing solution from flying off from the surface of the recording element substrate and being re-applied thereto.

In recent years, there has been a demand for providing in the market an ink jet recording head that is cheaper while retaining high recording quality. In order to reply to this demand, it is necessary to extremely diminish the size of the recording element substrate that is the most expensive in the ink jet recording head and to increase the number of recording element substrates producible from one wafer. However, when the size of the recording element substrate is diminished, a wall portion around an ejection orifice inevitably becomes fine, and the rigidity of the recording element substrate is lowered. Therefore, the recording element substrate is liable to be deformed or broken by slight force.

An ink jet recording head is subjected to a heat treatment for curing the sealing material after the sealing step. Since the curing temperature of the sealing material is higher than room temperature, the sealing material is cured and shrunk before returned to room temperature to restrain the recording element substrate. A resin material is generally used in the support member due to the advantage that it can be cheaply produced, and the recording element substrate is mainly formed with a silicon material, so that both are different from each other in coefficient of thermal expansion. Upon sealing, the recording element substrate and the support member become a more expanded state than those at room temperature, so that a difference in thermal expansion between the recording element substrate and the support member is created to mutually restrain them through the sealing material after the curing.

As a result, the internal stress of the recording element substrate may have been increased in some cases to deform the recording element substrate. An ink ejected from an ink jet recording head having the recording element substrate deformed as described above changes its ejecting direction, so that its impact position is dislocated to cause lowering of recording quality. Thus, it is considered that sealing of a portion, on which no electrical connection portion is provided, of the recording element substrate is omitted or simplified to reduce the restraining force of the sealing material.

On the other hand, it is desirable to provide a groove around a joint portion for joining the recording element substrate to the support member. By providing the groove, a meniscus is formed upon coating of an adhesive to stabilize the coating height of the adhesive. However, the groove remains along a peripheral portion of the recording element substrate when the sealing material is not provided after the joint. When the washing solution enters this groove portion in the washing step after the printing test, it is difficult to remove the washing solution in the next drying step. When being transferred to the next step while the washing solution remains in the groove portion, the washing solution flies off by vibration upon the transfer and re-applied to the surface of the recording element substrate to cause ink bleeding or color mixing upon application of the tape.

The groove described in Japanese Patent Application Laid-Open No. 2006-239992 is useful to discharge water on the recording element substrate and the electrical wiring substrate. However, it is difficult to effectively discharge the washing solution remaining in the groove portion in the neighborhood of the joint portion of the recording element substrate.

SUMMARY OF THE INVENTION

According to the present invention, there is provided a liquid ejection head comprising: a recording element substrate including an ejection orifice forming member provided with an ejection orifice for ejecting a liquid, and a substrate provided with an energy-generating element that generates energy utilized for ejecting the liquid; an electrical wiring substrate including a plurality of wirings connected to a plurality of terminals that are formed along an end portion side of a surface of the substrate on which surface the energy-generating element has been formed and are electrically connected to the energy-generating element; and a support member including a support portion supporting the recording element substrate through an adhesive, a groove portion formed around the support portion and an electrical wiring support portion supporting the electrical wiring substrate, wherein a sealing material is applied to a connection portion between the terminals and the wirings, and wherein the sealing material is applied to a bottom surface of the groove portion formed on an end portion side of the surface on which side no terminal is formed, and at least a part of a side of the substrate corresponding to the end portion side of the substrate on which side no terminal is formed is exposed without being covered with the sealing material.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1A:
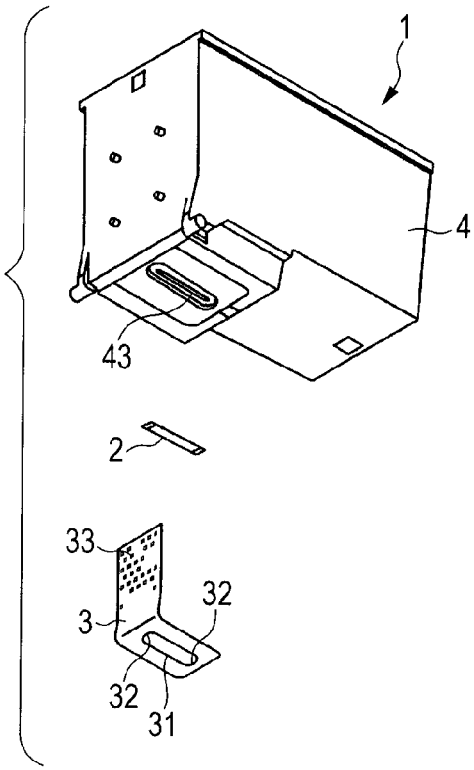
FIGS. 1A and 1B are schematic perspective Views illustrating an ink jet recording head according to the present invention.
Figure 1B:
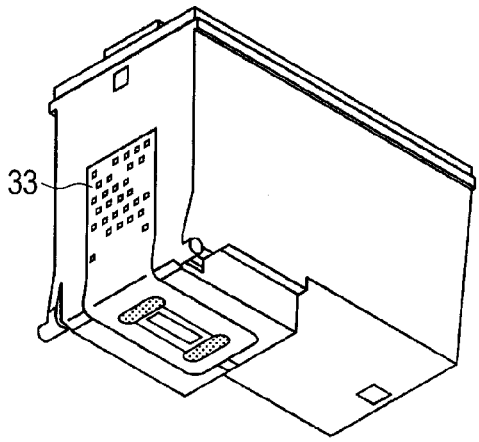

FIGS. 1A and 1B are schematic perspective views of an ink jet recording head according to a first embodiment. FIG. 1A is an exploded perspective view of the ink jet recording head, and FIG. 1B is a perspective view when assembled. An ink jet recording head 1 is mainly comprised of a recording element substrate 2, an electrical wiring substrate 3 and a support member 4.

Figure 2:
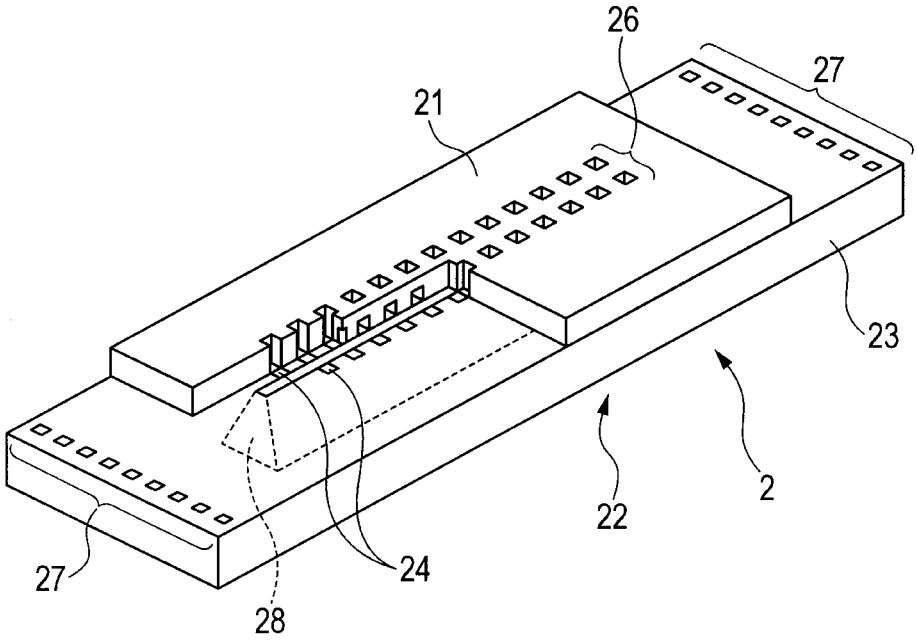
FIG. 2 is a schematic perspective view illustrating a recording element substrate in a first embodiment.

FIG. 2 is a schematic perspective view illustrating the recording element substrate. The recording element substrate 2 is formed from a silicon substrate having a thickness of 0.6 to 0.8 mm and an ejection orifice forming member provided with an ejection orifice. The recording element substrate has an ejection orifice surface 21, a back surface 22 opposing the ejection orifice surface 21 and a plurality of sides 23 (here, 4 sides) provided on side portions of the ejection orifice surface. A plurality of electrothermal conversion elements 24 as energy-generating elements for generating energy utilized for ejecting a liquid and electrical wirings (not illustrated) for supplying electric power to the respective electrothermal conversion elements 24 are formed on the ejection orifice surface 21 by a film forming technology. In addition, a group of ejection orifices (hereinafter referred to as the ejection orifice group 26) corresponding to the electrothermal conversion elements 24 is formed in the ejection orifice surface 21 by lithography. A connection terminal group 27 that is electrically connected to a lead terminal group 32 which will be described subsequently and is for receiving a driving signal and driving power is formed along at least one side, two sides in this embodiment, of the ejection orifice surface 21 of the recording element substrate 2. An ink supply port 28 for supplying an ink to the ejection orifice group 26 is provided being opened to the back surface 22 of the recording element substrate 2.

Figure 3:
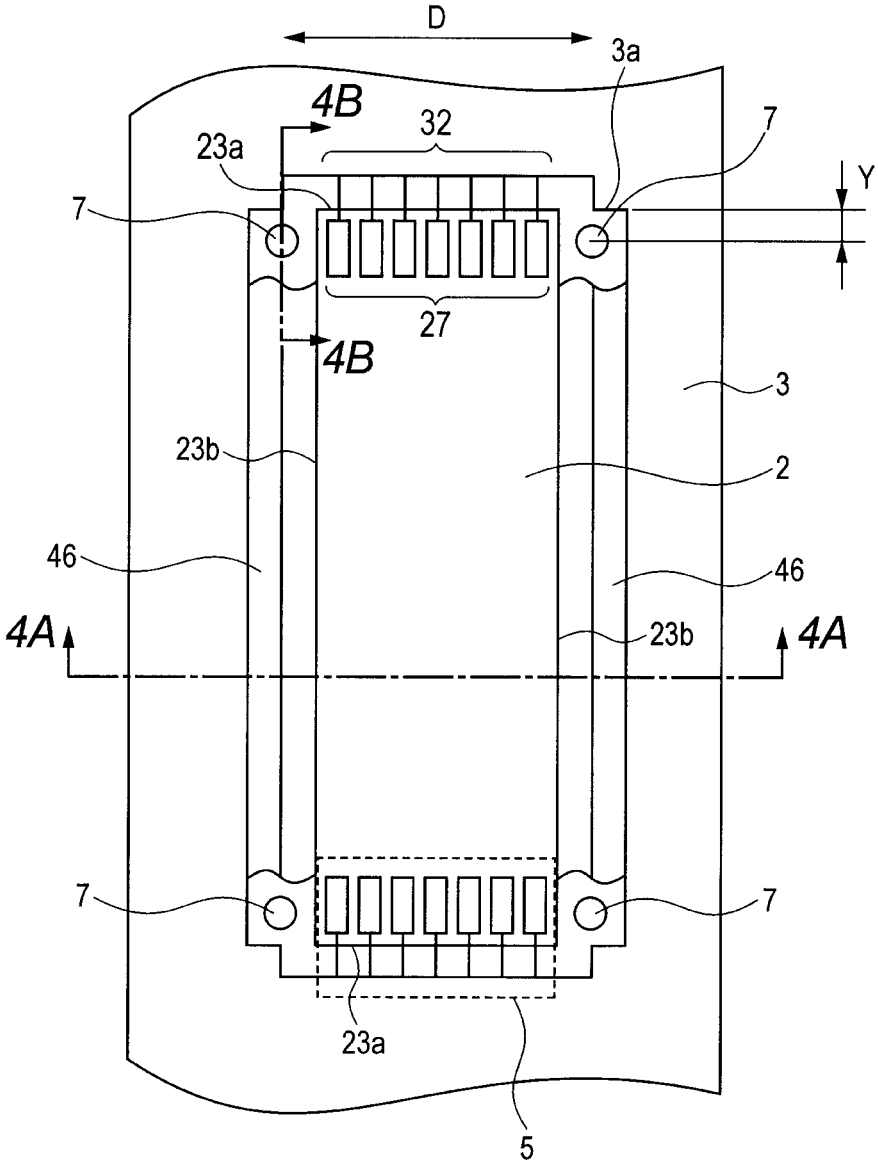
FIG. 3 is a plan view illustrating a support member to which a recording element substrate and an electrical wiring substrate have been fixed.
Figure 4A:
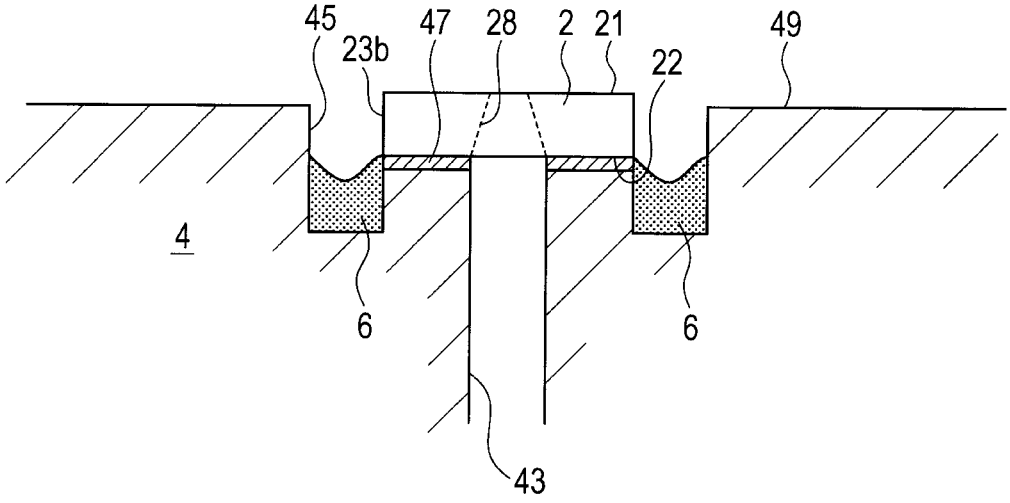
FIGS. 4A and 4B are sectional views respectively taken along line 4A-4A and line 4B-4B in FIG. 3.
Figure 4B:
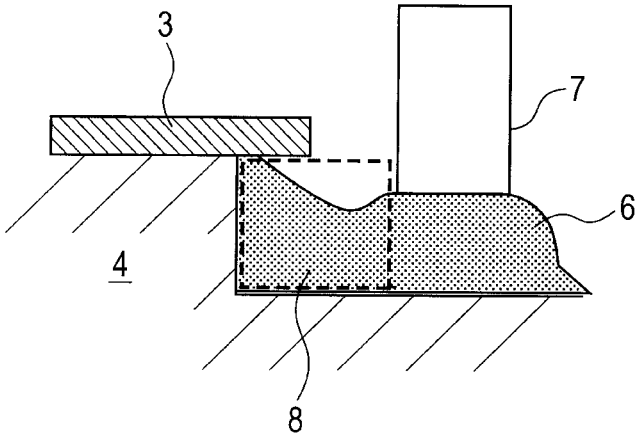
Figure 5A:
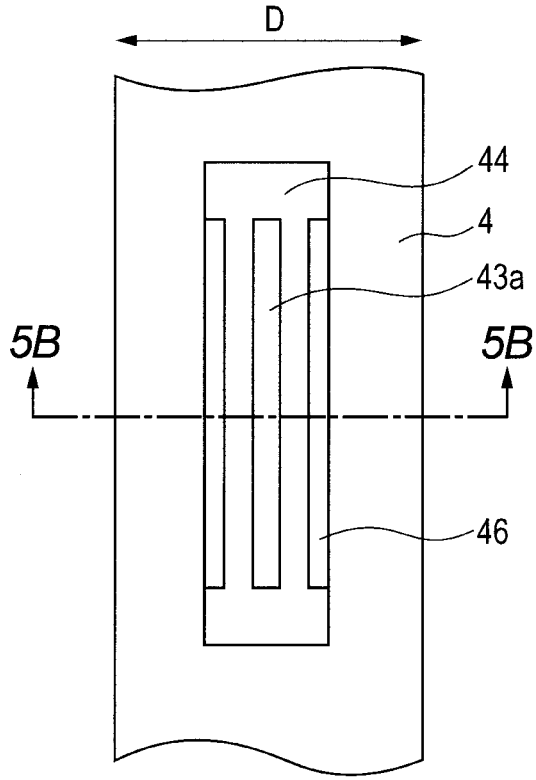
FIGS. 5A and 5B are conceptual views illustrating a region of a support member where the recording element substrate is joined.
Figure 5B:
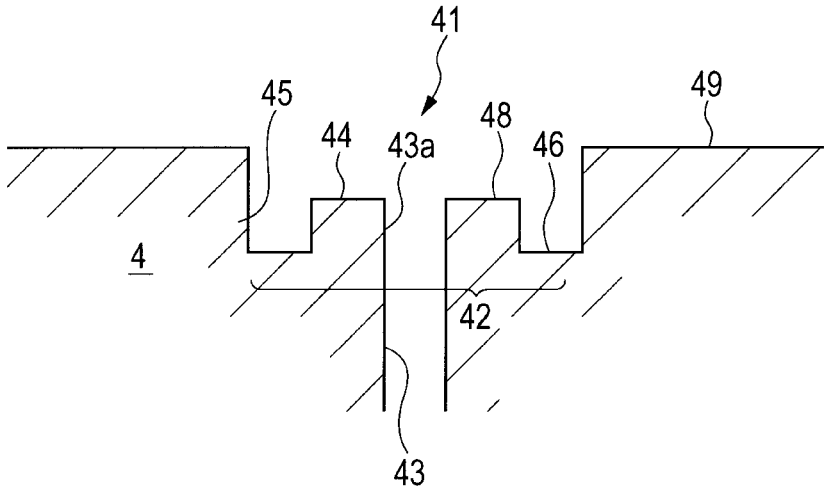

FIG. 3 is a plan view of the ejection orifice surface 21 of the support member 4 to which the recording element substrate 2 and the electrical wiring substrate 3 have been fixed. FIGS. 4A and 4B are sectional views illustrating a depressed portion in which the recording element substrate 2 has been held, and respectively taken along line 4A-4A and line 4B-4B in FIG. 3. In FIG. 4A, the illustration of the electrical wiring substrate 3 is omitted. FIGS. 5A and 5B are conceptual views illustrating a region of the support member 5 where the recording element substrate 2 is joined. FIG. 5A is a top view of the support member 4, and FIG. 5B is a sectional view taken along line 5B-5B in FIG. 5A and illustrating the perimeter of a portion coated with a sealing material by a needle and also illustrating a method for sealing the perimeter of the lead terminal group.

The electrical wiring substrate 3 is provided for the purpose of applying an electrical signal, for ejecting an ink, to the recording element substrate 2. The electrical wiring substrate 3 has a device hole 31 for incorporating the recording element substrate 2 as illustrated in FIGS. 1A and 1B, and a lead terminal group 32 corresponding to the connection terminal group 27 of the recording element substrate 2 is formed along two sides of the device hole 31 as illustrated in FIG. 3. The lead terminal group 32 forms an electrical connection portion 5 together with the connection terminal group 27 formed along the two sides of the ejection orifice surface 21. The electrical wiring substrate 3 further has an external signal input terminal 33 for receiving a driving signal and driving power from the ink jet recording apparatus as illustrated in FIGS. 1A and 1B.

A plurality of sides 23 is each composed of an electrical connection portion forming side 23*a* formed on the side on which the electrical connection portion 5 is provided and an electrical connection portion non-forming side 23*b* formed on the side on which the electrical connection portion 5 is not provided. The electrical connection portion forming side 23*a* forms a side 23 on the side of a short side of the recording element substrate 2, and the electrical connection portion non-forming side 23*b* forms a side 23 on the side of a long side of the recording element substrate 2.

Resin materials and ceramic materials typified by $Al_2O_3$ may be widely used as a material forming the support member 4. In this embodiment, however, a modified PPE (poly(phenylene ether)) resin containing a glass filler in an amount of about 35% is used for the purpose of improving the rigidity of the support member 4.

A depressed portion 41 formed in the support member 4 holds the recording element substrate 2 with the ejection orifice surface 21 turned toward the outside. A bottom surface 42 of the depressed portion 41 includes an opening 43*a* of an ink flow path 43 communicating with the ink supply port 28 and supplying an ink to the recording element substrate 2, a principal plane 44 and a groove portion 46 extending between the principal plane 44 and a side wall 45 of the depressed portion 41. The recording element substrate 2 is joined to the support member 4 on the principal plane 44 through an adhesive 47. The principal plane 44 produces a meniscus at a boundary portion 48 with the grooved portion 46 when the adhesive 47 is applied along the peripheral portion of the ink flow path to prevent the adhesive 47 from flowing out to the outside. By providing the groove portion 46 in this manner, the meniscus is formed upon the application of the adhesive, so that the adhesive can be thickly and stably applied. In this embodiment, the groove portion 46 is arranged only between the side wall 45 of the depressed portion 41 and the electrical connection portion non-forming side 23*b*. However, the groove portion may be arranged in the whole peripheral region of the opening 43*a* of the ink flow path 43.

The volume of the groove portion 46 is determined by the amount of a sealing material 6 flowing into between the side wall 45 of the groove portion 41 and the electrical connection portion non-forming side 23*b* of the recording element substrate 2 and was controlled to 5.58 $mm^3$ (15.5 mm×1.2 mm×0.3 mm) in this embodiment.

A production process of the ink jet recording head 1 will now be described.

The recording element substrate 2 and the electric wiring substrate 3 are first positioned in such a manner that the connection terminal group 27 of the recording element substrate 2 can be connected to the lead terminal group 32 of the electrical wiring substrate 3, and these terminal groups 27 and 32 are electrically connected by the TAB mount technology. The electrical connection portion 5 is thereby formed between the connection terminal group 27 of the recording element substrate 2 and the lead terminal group 32 of the electrical wiring substrate 3. The adhesive 47 is then applied along the periphery of the opening 43*a* of the ink flow path 43 on the principal plane 44 of the support member 4 to join the recording element substrate 2 to the support member 4. The ink flow path 43 of the support member 4 is thereby communicated with the ink supply port 28 of the recording element substrate 2. Upon the joint of the recording element substrate 2 to the support member 4, the adhesive 47 is pressed by the back surface 22 of the recording element substrate 2 after the adhesive 47 is applied so as not to greatly vary the coating height of the adhesive 47. The adhesive 47 is collapsed and projected out of the whole periphery of the sides 23 of the recording element substrate 2. Ink leakage from between the support member 4 and the recording element substrate 2 is thereby prevented. Thereafter, the electrical wiring substrate 3 is joined to the principal plane 44 of the support member 4 with an adhesive (not illustrated). The adhesives used in these joint steps are favorably ink-resistant. For example, a thermosetting adhesive containing an epoxy resin as a main component may be used.

A first space 8 between the electrical connection portion forming side 23*a* of the recording element substrate 2 and the side wall 45 of the depressed portion 41 is then sealed with the sealing material 6. At least a part of the grooved portion 46 extending along the electrical connection portion non-forming side 23*b* is further filled with the sealing material 6. Thereafter, the electrical connection portion 5 is sealed with the sealing material 6.

Specifically, the sealing material 6 is first applied to the first space 8 located below the lead terminal group 32 by means of a needle 7 as illustrated in FIGS. 4A and 4B. The sealing material 6 applied spreads out in the first space 8 by capillary force to seal the first space 8. The sealing material 6 remaining after the first space 8 is sealed flows into the groove portion 46 extending along the electrical connection portion non-forming side 23*b* and fills the groove portion 46. The electrical connection portion 5 (above the lead terminal group 32) formed by the connection terminal group 27 of the recording element substrate 2 and the lead terminal group 32 of the electrical wiring substrate 3 is then sealed, and the sealing material 6 is heated and cured. The same sealing material as the sealing material 6 sealing the electrical connection member 5 may fill the groove portion 46. Alternatively, the same sealing material 6 as the sealing material 6 sealing the first space 8 may fill the groove portion 46, and the electrical connection portion 5 may be then sealed with another sealing material.

Figure 6:
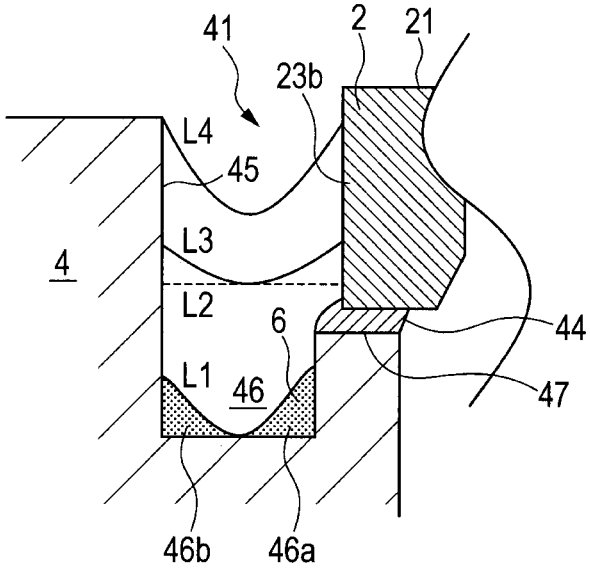
FIG. 6 is a schematic sectional view illustrating the neighborhood of a groove portion.

FIG. 6 is a schematic sectional view illustrating the neighborhood of a groove portion. Ideally, the sealing material 6 fills the groove portion 46 up to a position of a dotted line portion (level L2) in the drawing. A filled state of the sealing material 6 into the groove portion 46 varies according to wettability of the respective members and dispersion of a coating amount, so that the groove portion 46 may not be filled up to the position of the dotted line portion in FIG. 6 at all positions of the groove portion 46, but may be partially filled up to around a level L3 or L4. However, it is desirably that at least a part of the electrical connection portion non-forming side 23*b* of the recording element substrate 2 is exposed without being covered with the sealing material 6. The effect to restrain the recording element substrate 2 upon curing and shrinkage of the sealing material 6 can be thereby lightened to reduce internal stress generated in the recording element substrate 2. The whole of the electrical connection portion non-forming side 23*b* of the recording element substrate 2 is more favorably exposed without being covered with the sealing material 6. At least both corner portions 46*a* and 46*b* of the bottom surface of the groove portion 46 are desirably covered with the sealing material in such a manner that the washing solution does not remain in the groove portion 46 (level L1). The sealing material 6 fills the groove portion 46 up to the position of the dotted line portion in the drawing, i.e., up to a position coming into no contact with the electrical connection portion non-forming side 23*b* of the recording element substrate 2, whereby the internal stress generated in the recording element substrate 2 can be inhibited, and moreover the remaining washing solution can be prevented.

In order to control the filling amount of the sealing material 6, it is important to control the coating position. In order to control the amount of the sealing material flowing into the groove portion 46, it is desirable to set the position of the needle 7, i.e., the coating position of the sealing material 6, around both ends of the first space 8 in a lead terminal arranging direction D. The sealing material 6 applied is predominantly directed toward a center of the first space 8 for filling by capillary force generated in the first space 8, i.e., a space below the lead terminal group 32, and the remainder sealing material 6 fills the groove portion 46. In this embodiment, the needle coating position Y in a direction perpendicular to the lead terminal arranging direction D was controlled so as to be located within 700 μm from an end portion 3*a* of the electrical wiring substrate 3. In addition, the amount of the sealing material 6 applied was controlled to about 20 mg.

Thereafter, the ink jet recording head 1 is subjected to a printing test, and the surface of the recording element substrate 2 is finally washed, dried and sealed with a tape.

Second Embodiment

A second embodiment of the present invention will now be described. This embodiment may be suitably applied to an ink jet recording head capable of ejecting a plurality of inks.

Figure 7:
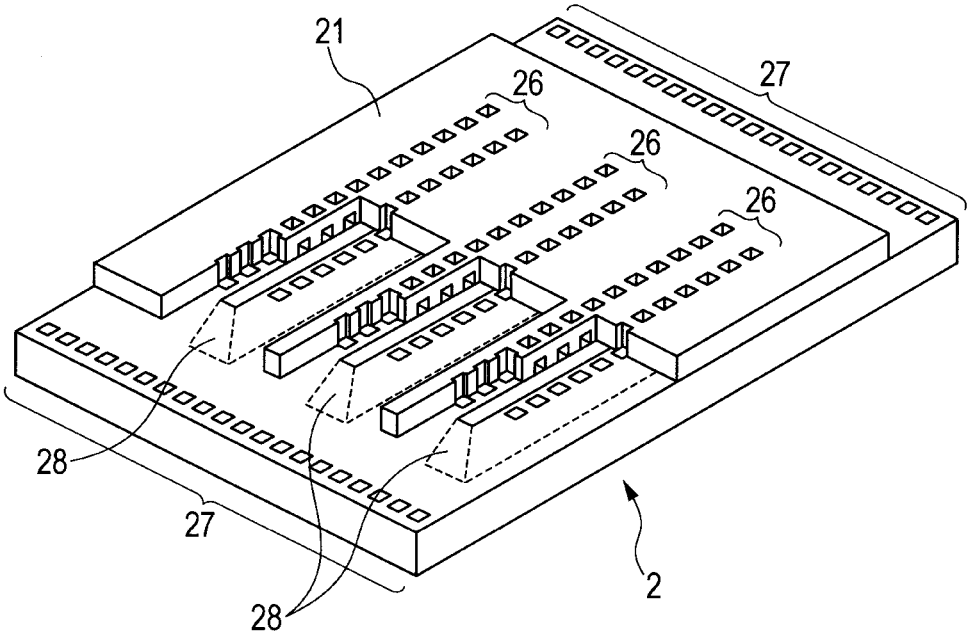
FIG. 7 is a schematic perspective view illustrating a recording element substrate in a second embodiment.

FIG. 7 is a perspective view illustrating a recording element substrate 2 in this embodiment. Three ink flow paths 43 and three ejection orifice groups 26 are provided, and three ink supply ports 28 for supplying an ink to the respective ejection orifice groups 26 are formed so as to be opened to a back surface 22 of the recording element substrate 2.

Figure 8:
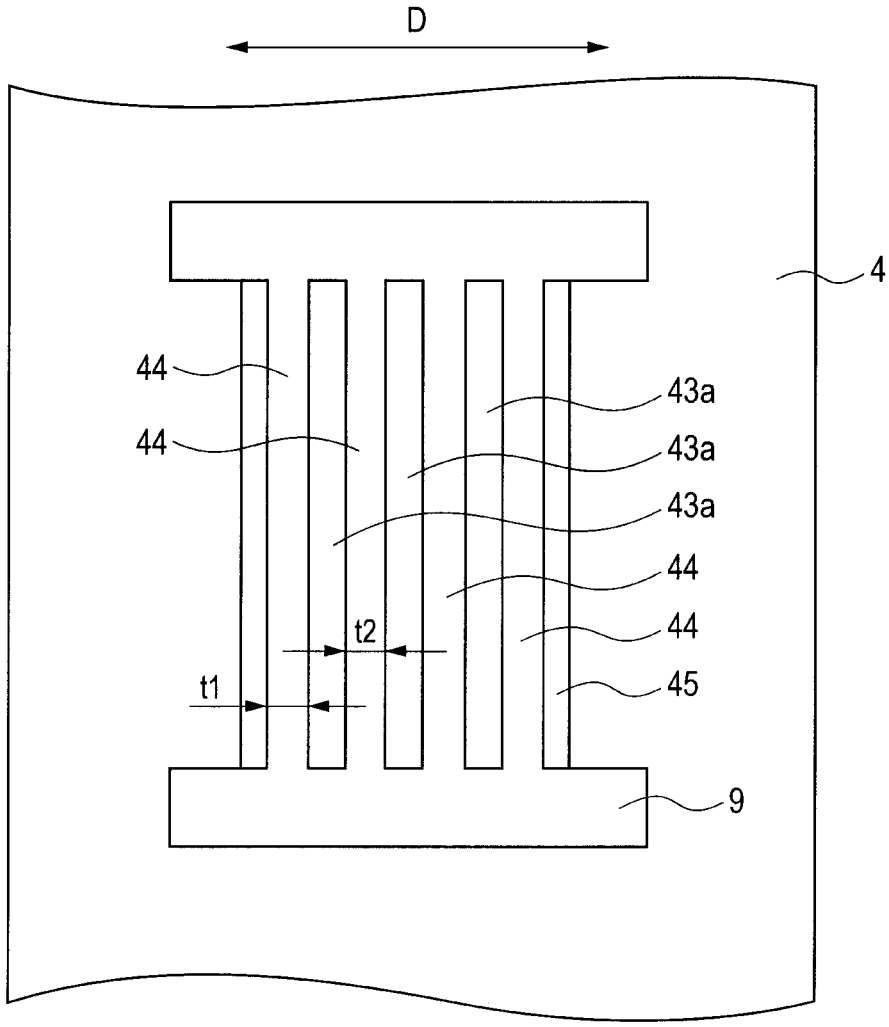
FIG. 8 is a conceptual view illustrating a region of a support member where the recording element substrate illustrated in FIG. 7 is joined.

FIG. 8 is a plan view illustrating a support member in this embodiment. A depressed portion 41 of the support member 4 includes a principal plane 44 to which the recording element substrate 2 is joined, openings 43*a* of the ink flow paths 43 for supplying an ink to the recording element substrate 2, and a groove portion 46. The three ink flow paths 43 are formed at an equal spacing, and the groove portion 46 is arranged in parallel with the ink flow path 43 between the ink flow path 43 of an end portion and a side wall 45 of the depressed portion 41. A spacing t1 between the groove portion 46 and the ink flow path 43 adjoining this groove portion and a spacing t2 between the respective ink flow paths 43 are all controlled to an equal spacing, and so surfaces of an adhesive 47 applied are all controlled to have an equal width. Therefore, the coating thickness of the adhesive 47 is controlled evenly. The volume of the groove portion 46 was controlled to 5.2 $mm^3$ (8.7 mm×1.2 mm×0.5 mm). A sealing material 6 flowed out into the grooved portion 46 can thereby be efficiently contained in the groove portion 46.

In this embodiment, a size of the recording element substrate 2 in the lead terminal arranging direction D is made large for corresponding to the plural inks. Therefore, a sealed region below the lead terminal group 32 is enlarged, and the amount of the sealing material 6 required is also increased. When the amount of the sealing material 6 required is increased, the sealing material 6 overflows to the ejection orifice surface 21 of the recording element substrate 2 when the necessary amount of the sealing material 6 is applied at a time to cause printing failure. Therefore, it is necessary to apply the sealing material 6 plural times for dealing with plural inks according to the constitution of the first embodiment. In this embodiment, a sealing material storing portion 9 is formed in the neighborhood of both ends of the connection terminal group 27 of the recording element substrate 2. The sealing material storing portion 9 is provided at a position projected to the outside from both ends of the first space 8 and communicated with the first space 8 and the groove portion 46. The sealing material 6 required to seal the first space 8 below the lead terminal group 32 and to fill the groove portion 46 is temporally stored in the sealing material storing portion 9 and fills the first space 8 by capillary force. In addition, the remainder sealing material 6 fills the groove portion 46. A necessary sealing material 6 is successively sent from the sealing material storing portion 9, so that the sealing material can be applied by only one coating.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-052980, filed Mar. 10, 2011, which is hereby incorporated by reference herein in its entirety.

What is claimed is:

1. A liquid ejection head comprising:

a recording element substrate including an ejection orifice forming member provided with an ejection orifice for ejecting a liquid, and a substrate provided with a surface on which an energy-generating element that generates energy utilized for ejecting the liquid is formed, the recording element substrate having a first edge along which a plurality of terminals electrically connected to the energy-generating element are formed, and a second edge along which no terminal is formed;

an electrical wiring substrate including a plurality of wirings connected to the plurality of terminals formed on the surface along the first edge; and a support member including a substrate support portion supporting the recording element substrate through an adhesive, a groove portion formed along the substrate support portion and an electrical wiring support portion supporting the electrical wiring substrate, wherein a sealing material is applied to a connection portion between the terminals and the wirings, and wherein the sealing material is applied to at least a portion of a bottom surface of the groove portion formed along the second edge, and at least a part of a side wall of the recording element substrate corresponding to the second edge is exposed without being covered with the sealing material.

2. The liquid ejection head according to claim 1, wherein a corner portion of the bottom surface of the groove portion is covered with the sealing material.

3. The liquid ejection head according to claim 1, wherein a sealing material storing portion is provided at an end portion of the groove portion formed along the first edge.

4. The liquid ejection head according to claim 3, wherein the sealing material storing portion is in communication with the groove portion.

* * * * *